US011248785B2

(12) United States Patent
Miller et al.

(10) Patent No.: US 11,248,785 B2
(45) Date of Patent: Feb. 15, 2022

(54) COAL NOZZLE ASSEMBLY FOR A STEAM GENERATION APPARATUS

(71) Applicant: General Electric Technology GmbH, Baden (CH)

(72) Inventors: William Ross Miller, Baden (CH); Rachel Ladue, Windsor, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 217 days.

(21) Appl. No.: 16/634,981

(22) PCT Filed: Jul. 26, 2018

(86) PCT No.: PCT/EP2018/070323
§ 371 (c)(1),
(2) Date: Jan. 29, 2020

(87) PCT Pub. No.: WO2019/025289
PCT Pub. Date: Feb. 7, 2019

(65) Prior Publication Data

US 2020/0232638 A1 Jul. 23, 2020

(30) Foreign Application Priority Data

Jul. 31, 2017 (EP) ..... 17184077

(51) Int. Cl.
*F23D 1/00* (2006.01)
*F23C 5/32* (2006.01)
(Continued)

(52) U.S. Cl.
CPC ..... *F23D 1/00* (2013.01); *F23C 5/32* (2013.01); *F23C 5/06* (2013.01); *F23C 7/02* (2013.01);
(Continued)

(58) Field of Classification Search
CPC ..... F23D 2201/10; F23D 2201/101; F23D 2201/20
See application file for complete search history.

(56) References Cited

U.S. PATENT DOCUMENTS 4,434,727 A * 3/1984 McCartney ..... F23C 5/06 110/261
4,634,054 A * 1/1987 Grusha ..... F23C 5/06 239/423
(Continued)

FOREIGN PATENT DOCUMENTS

EP 0 976 977 A1 2/2000
EP 2 068 077 A1 6/2009
(Continued)

OTHER PUBLICATIONS

International Search Report of the International Searching Authority for PCT/EP2018/070323 dated Oct. 11, 2018.

*Primary Examiner* — David J Laux
(74) *Attorney, Agent, or Firm* — Grogan, Tuccillo & Vanderleeden, LLP

(57) ABSTRACT

A steam generating system includes a furnace, a nozzle tip assembly for pulverized coal and primary air as well as means for conveying secondary air in the furnace. The nozzle according to the invention comprises a nozzle body (3) and several channels (5) being connected with the nozzle body, the channels are diverging from each other. At the exit faces (17) of the channels obstructions (13) are disposed to induce huge turbulences of the primary air when entering the furnace. Due to these turbulences the primary air and the entrained coal are mixed very well before being combusted in the furnace. This results in a better more effective combustion with reduced NOx-emissions.

17 Claims, 7 Drawing Sheets

(51) Int. Cl.
*F23C 5/06* (2006.01)
*F23C 7/02* (2006.01)

(52) U.S. Cl.
CPC .... *F23D 2201/101* (2013.01); *F23D 2201/20* (2013.01)

(56) References Cited

U.S. PATENT DOCUMENTS

| | | | | |
|---|---|---|---|---|
| 2008/0206696 | A1* | 8/2008 | Wark | F23D 1/02 431/202 |
| 2009/0277364 | A1* | 11/2009 | Donais | F23D 1/00 110/263 |
| 2010/0044457 | A1* | 2/2010 | Wark | F23D 1/02 239/11 |
| 2010/0064986 | A1 | 3/2010 | Kiyama et al. | |
| 2010/0081100 | A1* | 4/2010 | Olver | F23D 1/00 431/159 |
| 2011/0048293 | A1* | 3/2011 | Grusha | F23D 1/00 110/261 |
| 2014/0116359 | A1* | 5/2014 | Kiyama | F22B 1/1869 122/249 |

FOREIGN PATENT DOCUMENTS

| | | | |
|---|---|---|---|
| JP | S61 223411 | A | 10/1986 |
| JP | H01 217109 | A | 8/1989 |
| WO | 2009/114331 | A2 | 9/2009 |

* cited by examiner

Section A-A

COAL NOZZLE ASSEMBLY FOR A STEAM GENERATION APPARATUS

BACKGROUND OF INVENTION

This disclosure relates to a burner nozzle tip assembly for a steam generation apparatus for directing the flow of solid particles entrained in primary air into a combustor or into a furnace. It further relates to a steam generating system which comprises a furnace and at least one coal nozzle tip assembly.

PRIOR ART

A solid fueled firing system burns powdered solid fuel, typically coal, blown into a furnace in a stream of air. This furnace is typically a boiler that creates steam for various uses, such as creating electricity.

When the pulverized coal particles are conveyed through the duct work from the coal mill to the coal nozzle tip assembly by means of primary air they tend to aggregate at various paths. The resulting partial separation of coal particles and the primary air among other negative effects reduce the burning efficiency in the furnace and raise the pollutants in the fuel gas, which is undesirable.

From U.S. Pat. No. 8,955,776 a nozzle tip for solid fueled furnaces is known comprising several flat guide vanes arranged parallel to each other in the exit area of the nozzle to direct the flow of primary air and coal particles into the furnace.

The nozzle and the guide vanes are integrally formed for example by casting or welding. The guide vanes are more or less parallel to each other resulting in a sub-optimal mixture of the partially aggregated coal particles and the primary air before exiting the nozzle tip and entering the furnace.

Currently, there is a need for an improved coal nozzle tip assembly resulting in the ability to deal with the non-homogenous mixture of coal particles and primary air just before being burnt in the furnace thus resulting in a higher efficiency of the furnace and less pollutants, like for example NOx, in the flue gas. In addition there is a need to provide a larger range of stability of the burner and to also concurrently maintain or improve the combustion efficiency.

SUMMARY OF THE INVENTION

The claimed invention satisfies these needs by means of a coal nozzle tip assembly for a steam generation apparatus comprising a nozzle body and a group of channels being connected to the nozzle body, the channels being arranged so as to diverge from each other, wherein at an end distal from the connection between the nozzle body and the channels each channel comprises an exit face and wherein an obstruction is disposed in the exit faces of the channels. The number of channels may be 2, 3, 4 or more than 4. The channels have a rather similar main orientation although they are not parallel, but diverging.

Since the primary air with the entrained coal particles flows through the nozzle body and the channels more or less unaffected, the mixture of primary air and coal particles remains non-homogenous "as delivered" from the coal mill. The coal nozzle tip assembly may be designed rather simply and has a long service life. Only at the end of the channels near the exit faces in each channel an obstruction is disposed that causes heavy turbulences, once the primary air and the coal particles exit the coal nozzle tip assembly. This aggressively promotes the flame attachment and devolatization near the exit faces of the coal nozzle tip assembly. The channel is sized for the particular fuel properties present.

In addition to the simplicity of the claimed nozzle tip assembly it is a further advantage that no outer shroud for conveying secondary air is necessary. In other words, if the space for the nozzle tip assembly in an existing furnace is restricted, fitting or retrofitting the claimed nozzle tip assembly in this furnace allows the installation of a nozzle tip body and channels with greater cross section areas, which enhances the performance of the nozzle tip assembly and/or reduces the pressure drop of the nozzle tip assembly. The secondary air may be blown into the furnace on points distant from the nozzle tip assembly. This flexibility in the design is often very advantageous in case of a retrofit of an existing furnace.

The claimed coal nozzle tip assembly in a first step promotes a deviation in the mixture of coal particles and primary air, once the coal stream exits the nozzle body and enters in the diverting channels. Due to that, the claimed coal nozzle tip assembly has the ability to make the beginnings of flame attachment, even in situation of unstable mill and/or furnace performance. The origin of flame attachment is therefore robust and may be promoted in any channel, as conditions vary.

The flame attachment zone is starved of "fuel air" partially or completely to promote low temperatures in a first zone near the exit faces of the nozzle tip assembly, where the fuel is devolatized and then the char may be burnt in zones more remote from the exit faces in the fire wall.

Due to that it is possible to operate a steam generating system in compliance with emission regulations. Further, the injection of a reagent for secondary NOx production may be eliminated or at least strongly reduced.

Further, a steam generating system with coal nozzle assemblies according to claim 1 is able to be operated at a load down to 10% to 20% of the normal load without the need for support energy (e.g. gas or oil).

This means that it is possible to operate such a steam generation system according to the load in the electrical grid and being ready for increasing the load from 10% to 100%, if daily peaks of the energy consumption in the electrical grid appear.

The claimed nozzle tip assembly may be embodied in several forms. In all embodiments the nozzle body has a polygonal cross section area at the connection between the nozzle body and each of the channels has a polygonal cross section area, too. The addition of the cross section areas of the channels equals the cross section area of the nozzle body. So that the pressure drop at the connection between the nozzle body and the channels is minimized.

This means that the coal nozzle tip assembly is easy to manufacture. Further, at the link between the nozzle body and the channels low or only very small pressure drop occurs.

It has been proven advantageous, if the nozzle body has a square or rectangular cross section area and the channels have a square or rectangular cross section area, too.

To further reduce the pressure drop of the claimed nozzle tip assembly it is claimed that the cross-section area of each channel increases starting from the connection between nozzle body and the channels toward the exit faces of the channels at the distal ends of the channels. In other words: each channel is a diffusor. Due to that the velocity of the primary air and the coal particles in the channels is reduced and therefore the pressure drop inside the channels is reduced.

It has been proven advantageous, if the sum of the cross section areas of the channels at their distal ends is greater than the cross section areas of the connection between the nozzle body and the channels by a factor between 1.4 and 1.8, preferably by a factor of 1.6.

In a simple but effective embodiment of the obstructions they have the form of a bar extending between two opposite corners of the channels.

Due to that the bars are effective in causing turbulences in the primary air and the entrained particles directly after the primary air has left the exit faces. Since the sum of the cross section areas of the exit faces are greater than the cross sectional areas of the channels at their end proximal to the nozzle body, the obstructions do not cause a heavy pressure drop. As a result, the overall pressure drop of the claimed nozzle tip assembly is similar or smaller than the pressure drop of a conventional nozzle tip assembly.

It has been proven advantageously if the obstructions are cover approximately 50% of the cross section area of each channel.

A further advantage of the claimed coal nozzle tip assembly is that the nozzle body, the channels and the obstructions may be made of plain stainless sheet metal. This makes the manufacture and repair easy.

Two embodiments are claimed of the above burner tips, one being fixed non-tilting and the other tilting. In the tilting embodiment, the burner tip may be tilted up to 30 degrees from horizontal in much the same way as existing tips and may use a similar tilt mechanism.

In a further embodiment, to further reduce the NOx emissions of the claimed Ultra-Low NOx burner nozzles a catalyst is applied to the internal walls of the nozzle tip assembly. Catalytic combustion of the volatile matter in the injected fuel is achieved at temperatures favorable for the reduction of NOx species originating from the volatile matter or partial combustion of solid fuels. Catalytic combustion inside the nozzle tip assembly also improves the quality of the flame downstream and corresponding reduced NOx-emission within the furnace. This embodiment is equally applicable to the tilting or fixed nozzle tip embodiments.

Catalytic combustion near the exit face(s) of the nozzle tip(s) also improves the quality of the flame and corresponding reduced NOX emission within the furnace.

In an embodiment of this invention, the catalyst is of the perovskite-type with catalytic activity in the preferred temperature range, but not limited to, of 500° C. to 900° C. In an embodiment of this invention, the catalyst is Lanthanum Strontium Titanate doped with metals. Such metals are, but are not limited to, Fe, Mn, and Co.

Further advantages are disclosed in the figures, their description and the claims.

DETAILED DESCRIPTION OF THE DRAWINGS

Figure 1:
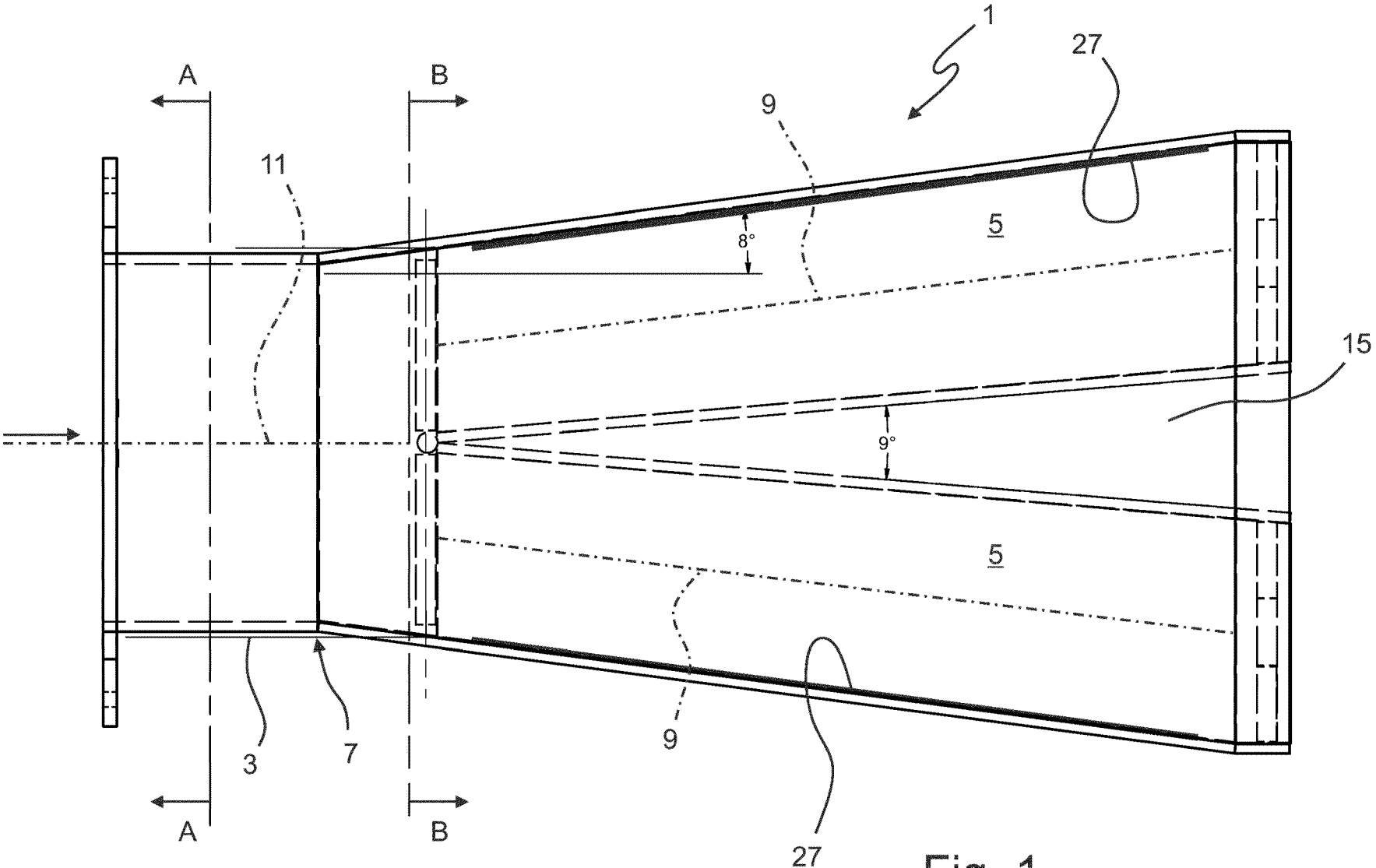
FIG. 1: A side view of a first embodiment of a nozzle tip assembly according to the invention.

FIG. 1 shows a side view of a first embodiment of the claimed nozzle tip assembly 1. The primary air with the entrained coal particles is conveyed from a coal mill through an appropriate duct work (not shown) and enters a nozzle body 3 of a nozzle tip assembly 1 on the left side in FIG. 1. Connected to the nozzle body 3 are four channels 5 (only two of them being visible in FIG. 1). The connection 7 between the nozzle body 3 and the channels 5 in most cases is a weld.

As can be seen from FIG. 1, the channels 5 diverge from each other. In other words: The longitudinal axis 9 of the channels includes an angle of approximately 5° to 10° with regard to a longitudinal axis 11 of the nozzle body 3.

The nozzle body 3 of this embodiment has a square cross section area as well as each of the four channels 5.

Figure 2:
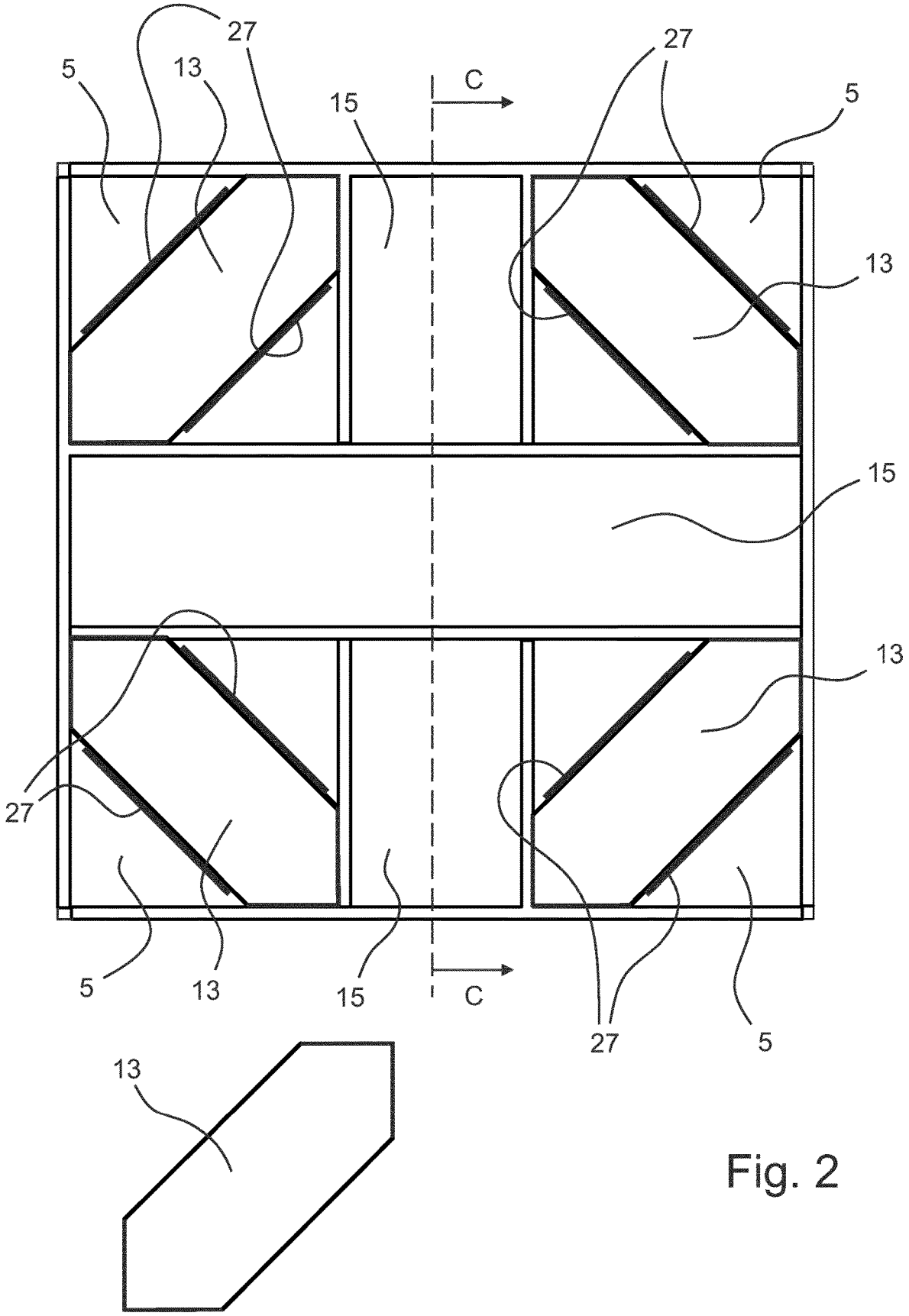
FIG. 2: a simplified front view of the nozzle tip assembly according to the invention.

FIG. 2 shows a simplified front view of the nozzle tip assembly 1, since it only shows the walls of the channels 5 and the obstruction 13 in each exit face of the channels 5. At the left part of FIG. 3 a single obstruction 13 is illustrated. This obstruction 13 may be cut out from a sheet metal and welded into the channels 5. As can be seen from FIG. 2, the obstructions 13 are arranged so that they build an "interrupted square". Between the channels 5 there are hollow spaces 50 that do not have any function. In most cases they are filled with a refractory (not shown).

Figure 3:
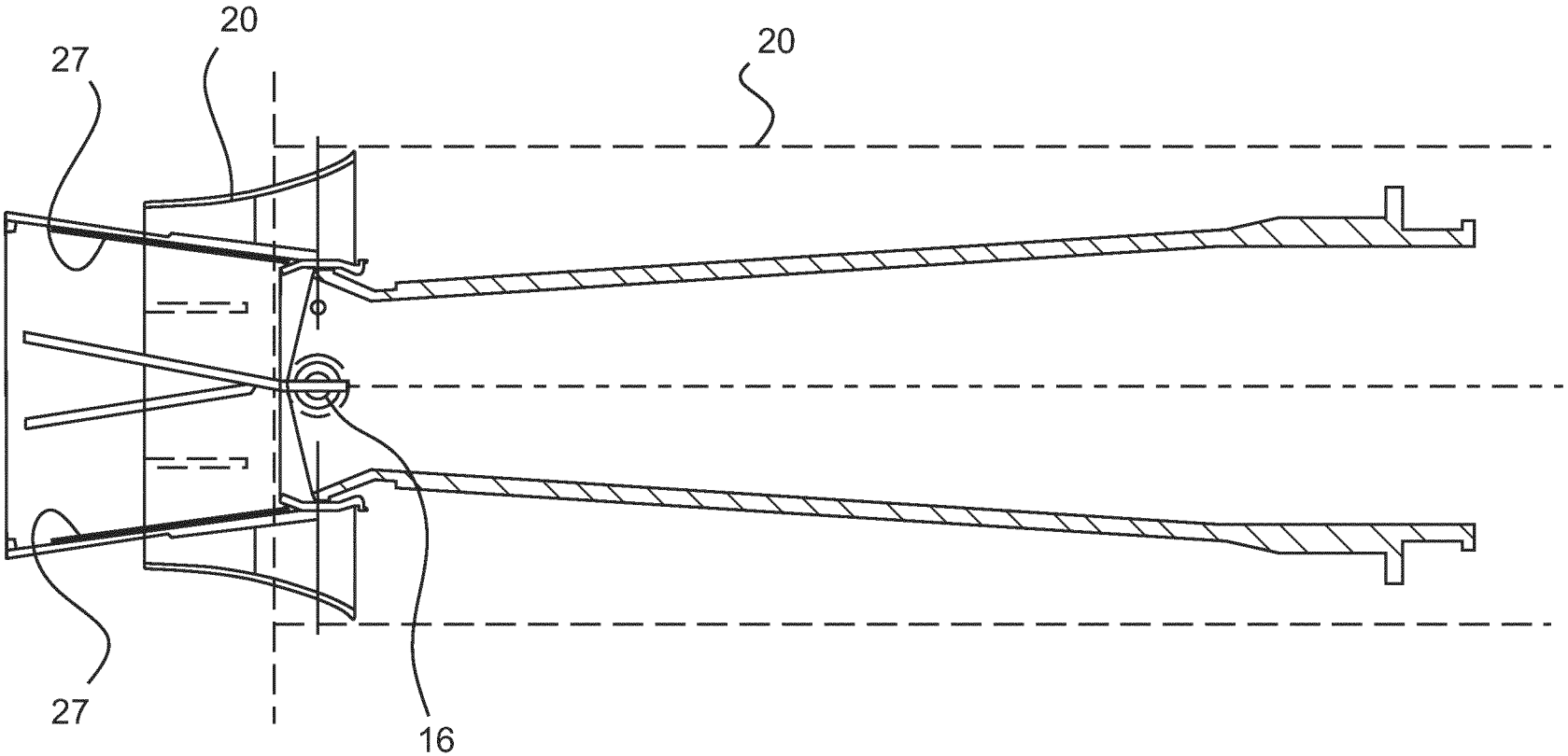
FIG. 3: a cross section of the nozzle tip assembly for the second embodiment for tilting nozzle tips.

FIG. 3 shows a side view of a second embodiment of the claimed nozzle tip assembly 1. The primary air with the entrained coal particles is conveyed from a coal mill through an appropriate duct work (not shown) and enters the nozzle body 3 (or coal burner pipe) on the right side in FIG. 3. The nozzle body 3 of the second embodiment and the first embodiment may increase the velocity of the primary air.

In this second embodiment the nozzle tip 1 is pivotally connected to the nozzle body 3 or an outer shroud 20 by a pair of pivot members 16. The pivot members 16 allow the nozzle tip 1 to be rotated or to be tilted about an axis (in most cases a horizontal axis) so that the fuel and combustion air can be directed upwardly or downwardly with respect to a vertical axis of the furnace. The pivotal connection of the nozzle tip 1 allows a redirection of the air within a range of approximately ±30°.

Figure 4:
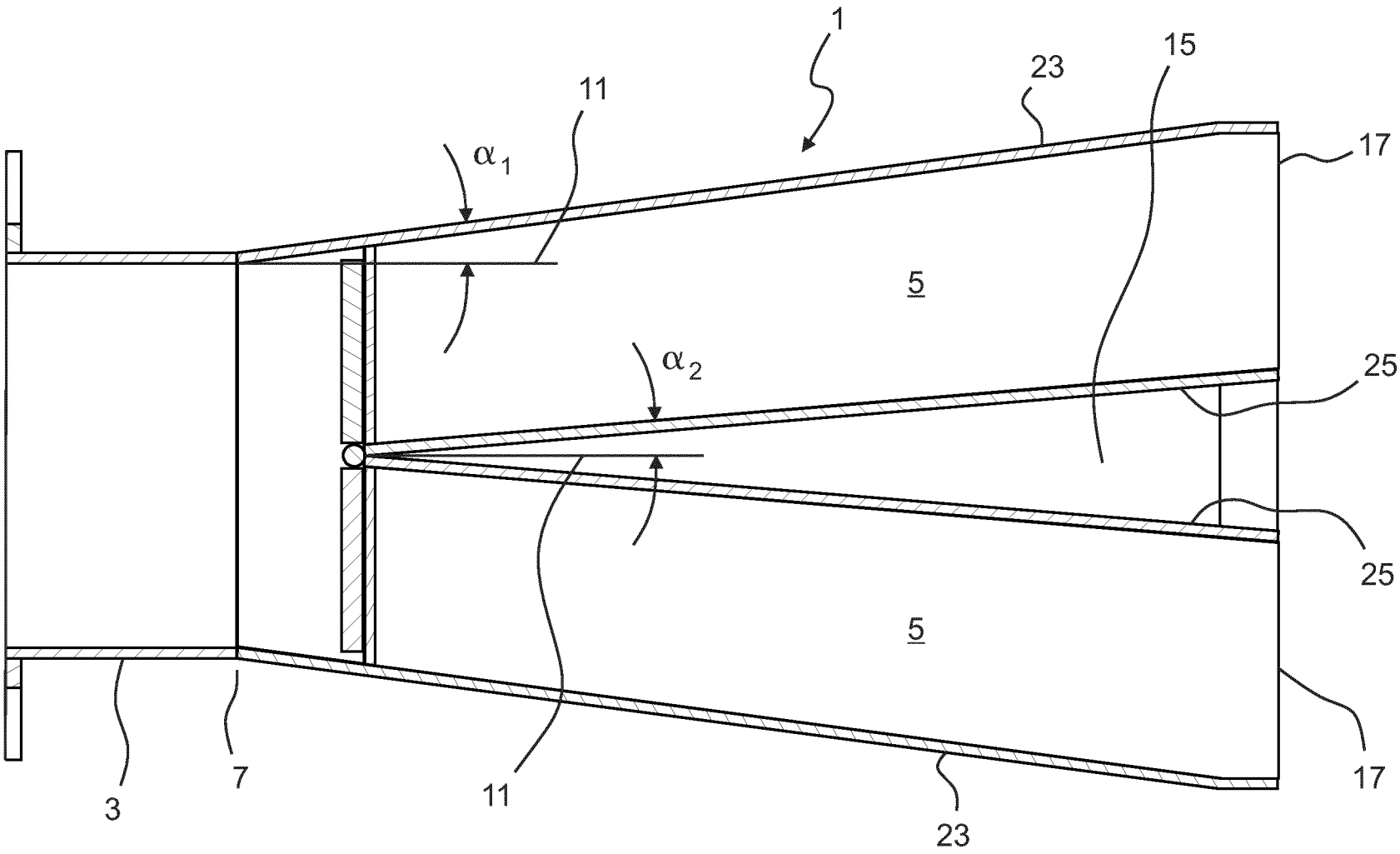
FIG. 4: a cross sectional view of the first embodiment.

As can be seen from FIG. 4, the channels 5 of the nozzle tip diverge from each other. In other words: The longitudinal axis 9 of the channels includes an angle of approximately 5° to 10° with regard to a longitudinal axis 11 of the nozzle body 3 if the nozzle tip 1 is in a horizontal position. The nozzle body 3 of the second embodiment has a square cross section area as well as each of the four channels 5.

To ensure that the primary air and the entrained coal particles enter the nozzle tip 1 seal plates 18 are located between nozzle body 3 and the nozzle tip 1.

The nozzle body 3 and most of the nozzle tip 1 are surrounded by an outer shroud 20 for conveying secondary air into the furnace (not shown). Since the gap between the outer shroud 20 and the nozzle tip 1 of this embodiment gets narrower towards the furnace the velocity of the secondary air is increased before it enters the furnace.

In FIG. 4 a longitudinal section along of the first embodiment is shown. From this cross section the hollow space 15 between the channels 5 can be seen. It further can be seen that the channels 5 are built as a diffusor, which means that the cross section area near the connection 7 is smaller than the cross section area near the exit faces 17 of the channels 5.

An angle α1 between the outer wall 23 of the channels 5 and a longitudinal axis 11 of the nozzle body 3 is approximately 8°. An angle α2 between the inner walls 25 of the channels 5 and the longitudinal axis 11 of the nozzle body 3 is approximately 5°. The angle α1 may range from 5° to 15°. The angle α2 may range between 2° and 10°.

In any case, the angle α1 is greater than the angle α2. Due to that fact the channels 5 are diffusors and the cross section area of the channels 5 at the exit faces 17 is larger than the cross section area at the connection 7. The same applies with regard to the nozzle tip 1 of the second embodiment.

Figure 5:
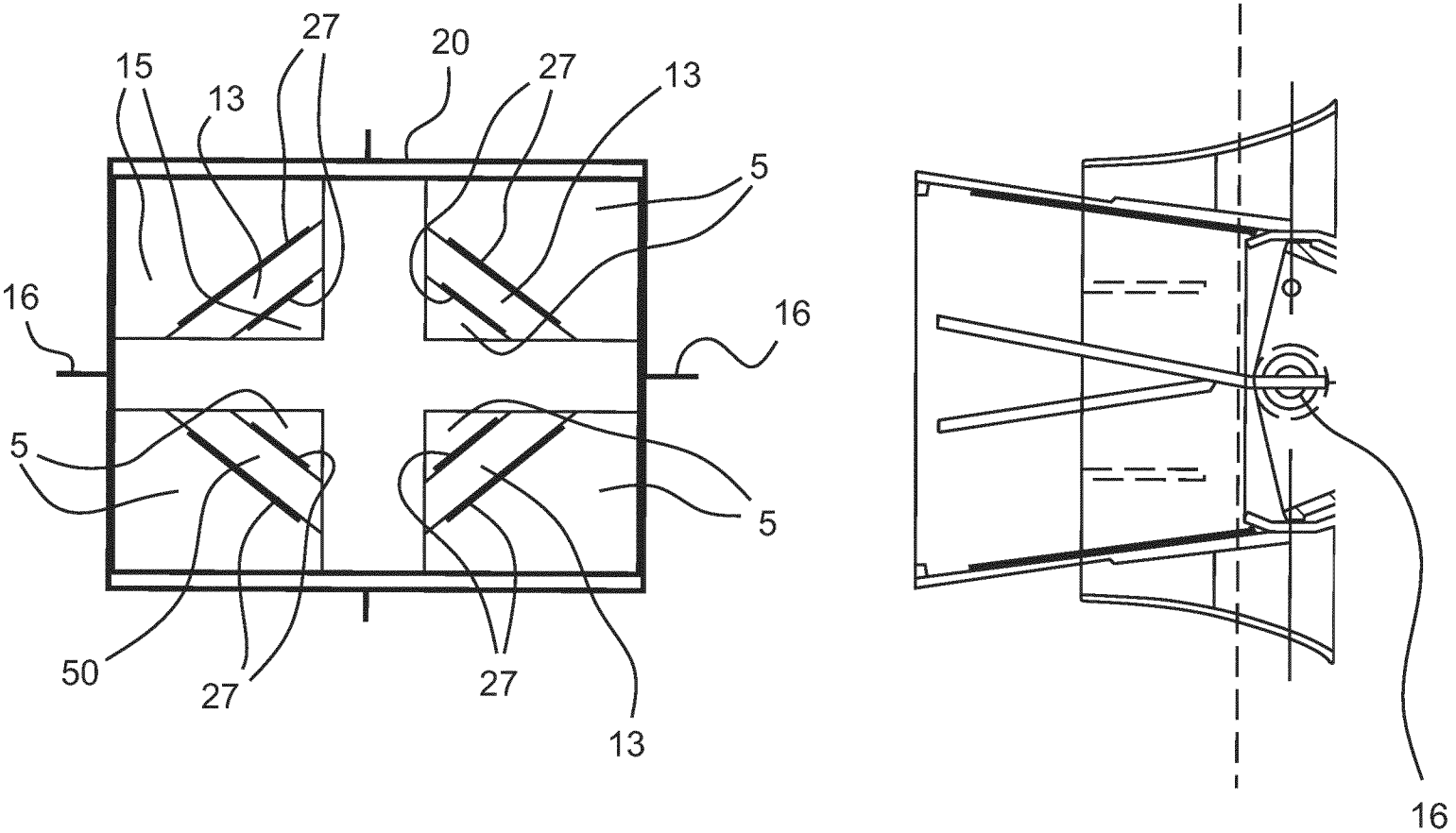
FIG. 5: a cross section and front view of the second embodiment.

FIG. 5 shows a simplified front view of a nozzle tip 1 according to the invention (first and second embodiment). Other than in FIG. 2 the obstructions 13 in each exit face of the channels 5 are less wide. They are welded on the two adjacent walls of the channels 5 that limit the hollow spaces 50.

Figure 6:
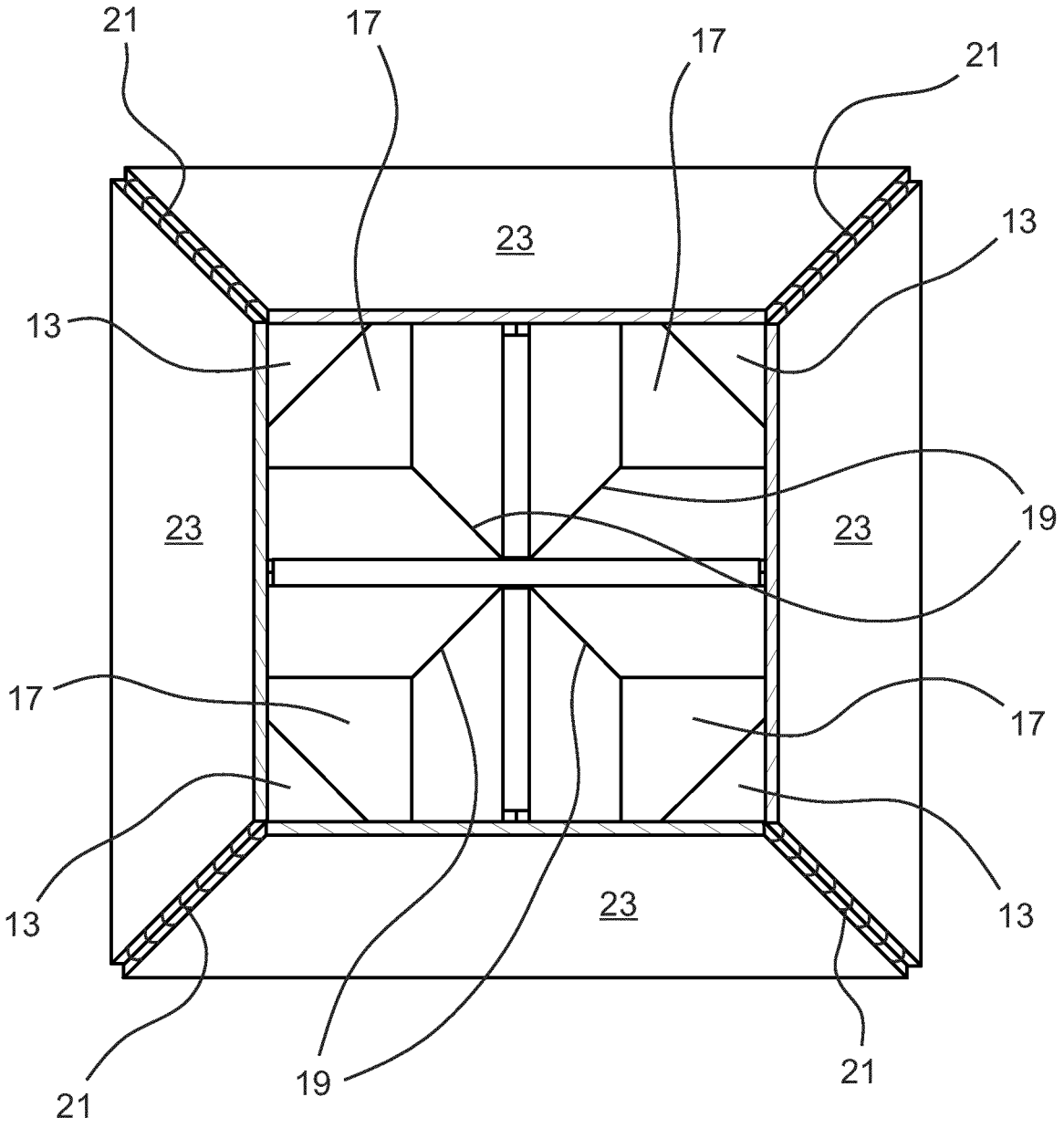
FIG. 6: a cross sectional view along the line B-B in FIG. 1 (generally applies to first and second embodiments)

FIG. 6 illustrates a view along the line B-B. It illustrates that the channels 5 are diverging. This can be seen for example by looking to the inner edges 19 of the channels 5. It further can be seen by the fact that the exit faces 17 of the channels 5 are distant from each other. A small part of the obstructions 13 in each channel can be seen in FIG. 5, too.

FIG. 6 also illustrates that each wall of the channels 5 can be cut out from a plane sheet metal and the claimed nozzle tip assembly can be manufactured by welding these sheet metal plates together. In FIG. 6 four welds 21 that connect the outer walls 23 of the channels 5 have the reference numeral 21.

Figure 7:
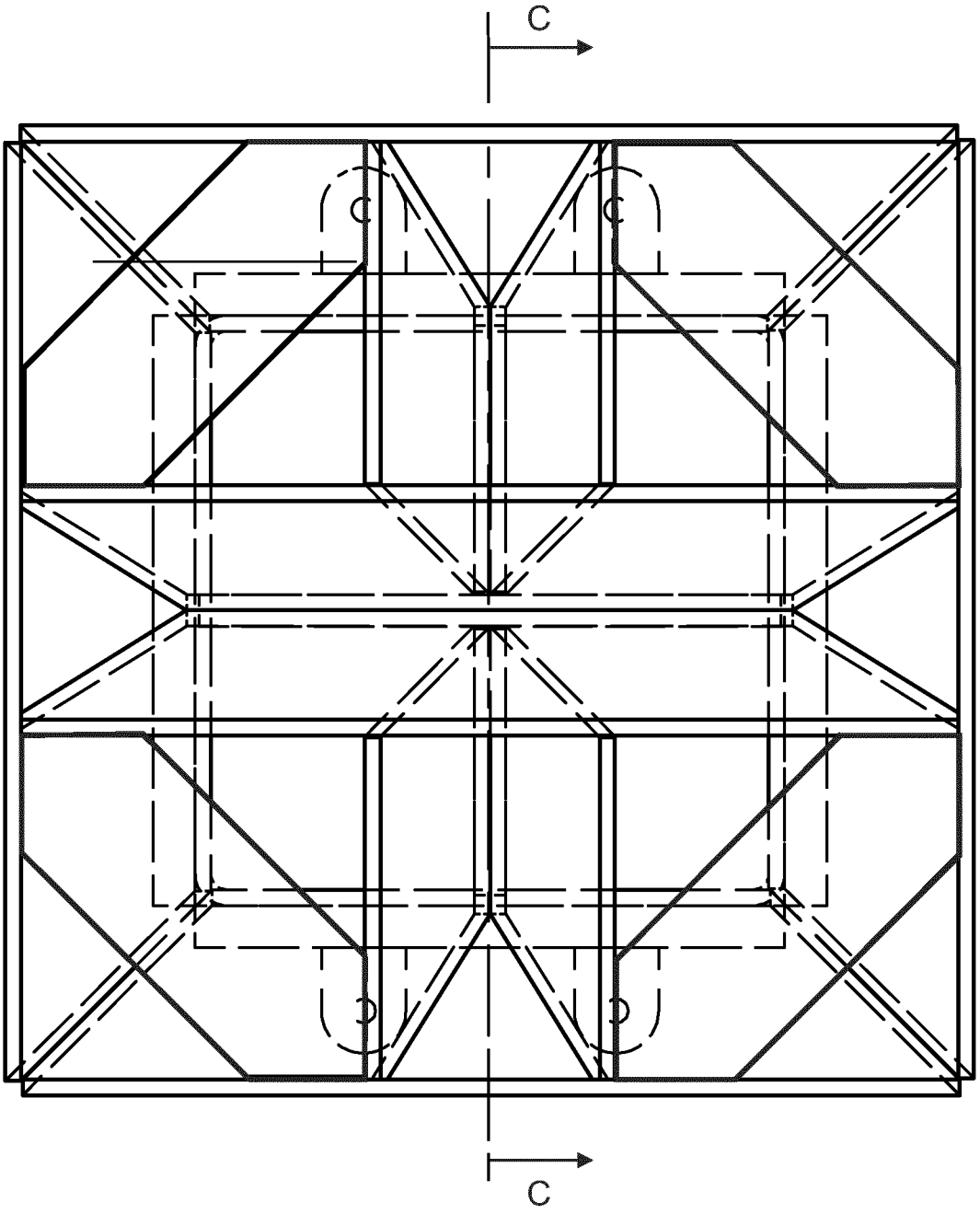
FIG. 7: a more detailed front view of the nozzle tip assembly according to the invention (generally applies to first and second embodiments).

FIG. 7 shows a front view with all visible lines of the nozzle tip assembly of the first embodiment. This front view is somehow confusing and for this reason a simplified front view has been explained in detail in FIG. 3. In FIG. 7 no reference numerals have been drawn to avoid overloading of this Figure with information.

LIST OF REFERENCE NUMERALS

1 Coal nozzle tip assembly
3 nozzle body
5 channels
7 connection between nozzle body and channels
9 longitudinal axis of the channels
11 longitudinal axis of the nozzle body
13 obstruction
15 hollow space
16 pivot members
17 exit faces
18 seal plates
19 inner edges of the channels
20 outer shroud
α angle
21 weld
23 outer wall of the channels 5
25 inner wall of the channels 5
27 catalyst

The invention claimed is:

1. A coal nozzle tip assembly for a steam generation apparatus, comprising: a nozzle body and several channels connected to the nozzle body, the channels arranged to diverge from each other, wherein at an end distal from the connection between the nozzle body and the channels each channel comprises an exit face, wherein a single obstruction is disposed in each exit face, the obstructions arranged to form a square interrupted by hollow spaces between the channels.

2. The coal nozzle tip assembly according to claim 1, wherein at the connection between nozzle body and the channels, the nozzle body has a polygonal cross section area, the channels have a polygonal cross section area, and the cross section areas of the channels equals the cross section area of the nozzle body.

3. The coal nozzle tip assembly according to claim 2, wherein at the connection between nozzle body and channels, the nozzle body has a square or rectangular cross section area and the channels have a square or rectangular cross section area.

4. The coal nozzle tip assembly according to claim 1, wherein the cross section area of each channel increases starting from the connection between nozzle body and the group of channels towards the exit faces at the distal ends of the channels.

5. The coal nozzle tip assembly according to claim 1, wherein the cross section area of each channel at the distal ends of the channels is greater than their cross section areas at the connection between nozzle body and the channels by a factor between 1.4 and 1.8.

6. The coal nozzle tip assembly according to claim 5, wherein the factor is 1.6.

7. The coal nozzle tip assembly according to claim 1, wherein the obstructions are in the form of a bar extending between two opposite corners of the channels.

8. The coal nozzle tip assembly according to claim 1, wherein the obstructions cover approximately 50% of the cross section area of its exit face.

9. The coal nozzle tip assembly according to claim 1, wherein the nozzle body, the channels and the obstructions are made of plain sheet metal.

10. The coal nozzle tip assembly according to claim 1, wherein the nozzle tip is surrounded by an outer shroud that conveys secondary air.

11. The coal nozzle tip assembly according to claim 1, wherein the nozzle tip is pivotally mounted to the nozzle body by pivot members.

12. The coal nozzle tip assembly according to claim 11, further comprising sealing plates between the nozzle tip and the nozzle body.

13. The coal nozzle tip assembly according to claim 1, wherein a catalyst is applied to the obstructions.

14. The coal nozzle tip assembly according to claim 13, wherein the catalyst is Lanthanum Strontium Titanate doped with metals.

15. The coal nozzle tip assembly according to claim 13, wherein the catalyst is of the perovskite-type having catalytic activity in a temperature range from 500° C. to 900° C.

16. A steam generating system, comprising:

a furnace;

at least one coal nozzle tip assembly to direct a flow of solid particles entrained in primary air into the furnace, wherein the at least one coal nozzle tip assembly includes a nozzle body and several channels connected to the nozzle body, the channels arranged to diverge from each other, wherein at an end distal from the connection between the nozzle body and the channels, each channel comprises an exit face, wherein a single obstruction is disposed in each exit face, the obstructions arranged to form a square interrupted by hollow spaces between the channels.

17. The steam generating system according to claim 16, further comprising at least one duct to convey secondary air into the furnace, wherein the at least one duct is distant from the at least one coal nozzle tip assembly.

* * * * *